US006612605B2

(12) United States Patent
Andrus et al.

(10) Patent No.: US 6,612,605 B2
(45) Date of Patent: Sep. 2, 2003

(54) INTEGRATED MODULAR GLIDE BOARD

(75) Inventors: Cameron Andrus, Vashon, WA (US); Anthony DeRocco, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/766,531

(22) Filed: Jan. 18, 2001

(65) Prior Publication Data

US 2001/0022439 A1 Sep. 20, 2001

Related U.S. Application Data

(63) Continuation-in-part of application No. 09/408,158, filed on Sep. 29, 1999, now Pat. No. 6,520,529.

(51) Int. Cl.[7] ..... A63C 5/00

(52) U.S. Cl. ..... 280/610; 280/607; 280/14.21; 280/14.22

(58) Field of Search ..... 280/14.21, 14.22, 280/610, 601, 602, 607, 608

(56) References Cited

U.S. PATENT DOCUMENTS

| | | | | |
|---|---|---|---|---|
| 2,258,046 | A | | 10/1941 | Clement |
| 2,539,224 | A | | 1/1951 | Beerli |
| 2,560,693 | A | | 7/1951 | Hickman |
| 3,260,532 | A | | 7/1966 | Heuvel |
| 3,414,279 | A | | 12/1968 | Allain |
| 4,679,813 | A | | 7/1987 | Girard |
| 4,681,725 | A | | 7/1987 | Maruyama |
| 4,697,821 | A | | 10/1987 | Hayashi et al. |
| 5,026,086 | A | | 6/1991 | Guers et al. |
| 5,035,442 | A | | 7/1991 | Arnsteiner |
| 5,249,819 | A | | 10/1993 | Mayr |
| 5,251,924 | A | | 10/1993 | Nussbaumer |
| 5,301,965 | A | | 4/1994 | Floreani |
| 5,303,948 | A | * | 4/1994 | Le Masson et al. ..... 280/607 |
| 5,366,234 | A | | 11/1994 | Rohrmoser |
| 5,393,086 | A | | 2/1995 | le Masson et al. |
| 5,397,150 | A | | 3/1995 | Commier et al. |
| 5,441,296 | A | | 8/1995 | Phelipon et al. |
| 5,447,322 | A | | 9/1995 | le Masson et al. |
| 5,501,825 | A | | 3/1996 | Jodelet |

(List continued on next page.)

FOREIGN PATENT DOCUMENTS

| | | |
|---|---|---|
| DE | 3315638 | 12/1983 |
| DE | 41 30 110 A1 | 2/1992 |
| EP | 0 563 569 A1 | 10/1993 |
| EP | 0 577 947 A1 | 1/1994 |
| EP | 0 846 479 A | 6/1998 |
| EP | WO 99/43397 | 9/1999 |
| FR | 2 693 379 | 1/1994 |
| FR | 2 718 650 A | 10/1995 |
| NL | 9 101 938 A | 6/1993 |
| NO | 73456 | 4/1948 |
| WO | WO 91/09653 | 7/1991 |

*Primary Examiner*—Brian L. Johnson
*Assistant Examiner*—J. Allen Shriver
(74) *Attorney, Agent, or Firm*—Christensen O'Connor Johnson Kindness PLLC

(57) ABSTRACT

A snowboard (110) includes a body (22) formed from a primary core (130) reinforced by a structural layer (132, 134) that wraps the primary core. A secondary core formed from first and second binding lifter plates (120) is disposed above the body and adhered thereto with an elastomeric layer (142). A top layer (136) overlies the secondary core and the exposed portions of the body to integrate the secondary core into the snowboard. The snowboard further includes a bottom layer (138) reinforced with edge strips (140). The integrated modular lifter plates provides additional leverage and vibration dampening at selected regions of the snowboard without significantly impacting the torsional and longitudinal flexibility of the center section (112) of the snowboard.

19 Claims, 7 Drawing Sheets

U.S. PATENT DOCUMENTS 5,573,264 A * 11/1996 Deville et al. ..... 280/602
5,769,445 A * 6/1998 Morrow ..... 280/610
5,820,154 A 10/1998 Howe
5,855,389 A * 1/1999 Andrus et al. ..... 280/602
5,884,934 A 3/1999 DeRocco et al.
5,895,067 A 4/1999 Stephanova et al.
5,944,335 A 8/1999 Riepler
5,954,356 A * 9/1999 Busby, Jr. et al. ..... 280/602
5,988,668 A * 11/1999 DeVille et al. ..... 280/602
RE36,453 E 12/1999 Abondance et al.
6,102,428 A * 8/2000 Bobrowicz ..... 280/607
6,217,041 B1 * 4/2001 Hauser et al. ..... 280/14.2
6,293,567 B1 * 9/2001 Menges ..... 280/14.21
2001/0001519 A1 * 5/2001 Couderc et al. ..... 280/14.22
2001/0005072 A1 * 6/2001 Heitzmann ..... 280/610
2001/0015541 A1 * 8/2001 Ouches ..... 280/623
2001/0022439 A1 * 9/2001 Andrus et al. ..... 280/610
2002/0005626 A1 * 1/2002 Haas et al. ..... 280/613
2002/0024187 A1 * 2/2002 Gyr ..... 280/14.22
2002/0158431 A1 * 10/2002 Porte ..... 280/14.22

* cited by examiner

INTEGRATED MODULAR GLIDE BOARD

CROSS REFERENCE TO RELATED APPLICATION

The present application is a continuation in part of U.S. patent application Ser. No. 09/408,158 filed Sep. 29, 1999 now U.S. Pat. No. 6,520,529.

FIELD OF THE INVENTION

The present invention relates to the construction of glide boards and particularly to methods of mass distribution in a snowboard.

BACKGROUND OF THE INVENTION

The distribution of mass along the length of an alpine ski is a key element that affects the dynamics of ski performance. The same consideration also applies to Nordic skis and snowboards. Mass distribution impacts the modal and nodal vibrational properties of the ski structure, which in turn determines how the ski handles shock and vibration.

Conventionally, skis were fashioned from solid or laminated wood. In more recent years, skis have been constructed from a core, formed of wood or foam, that is sandwiched between or encased by load carrying structural layers having a constant thickness. The structural layers may be formed of glass, carbon or polyaramide fiber reinforced resins or aluminum alloys, for example. The stiffness profile of the ski along its length, vital to performance, is conventionally obtained by varying the thickness of the core. The result of this is that the distribution of mass along the length of the conventional ski is coupled to the stiffness of the ski, both of which are determined primarily by the core thickness. A thicker core results in a larger beam formed from the load carrying layers that surround the core, and vice versa. A thinner core results in a smaller beam and less stiffness. This has meant that for conventional skis only relatively small variations in ski mass distributions are possible. It has thus been necessary to change ski length, change the mass of the ski tips, or to add external weights to alter a ski's dynamic behavior.

Other types of conventional skis have used a split core construction, i.e., a ski core formed from first and second core layers joined by an elastomeric layer. However, these split cores are still sandwiched between or encased by load carrying structural layers, thus again coupling ski stiffness and mass distribution.

SUMMARY OF THE INVENTION

The present invention provides an elongate glide board defining a fore body portion and a rear body portion. The glide board includes a body formed from a primary core reinforced by at least one load carrying structural layer. A secondary core overlies at least portions of the body outside of the at least one load carrying structural layer. A top layer covers at least the secondary core and any exposed portions of an upper surface of the body. A base layer covers a lower outer surface of the body.

In further aspects of the invention, an elongate glide board includes a longitudinal primary core defining upper and lower surfaces. A load carrying structural layer wraps at least the upper and lower surfaces of the primary core and defines corresponding upper and lower outer surfaces. A secondary core at least partially overlies the upper outer surface of the structural layer, above the primary core. A top layer covers at least the secondary core and any exposed portions of the upper outer surface of the structural layer. A base layer covers the lower outer surface of the structural layer below the primary core.

In a further aspect of the present invention, a method of fabricating an elongate glide board is provided. The method entails wrapping at least upper and lower surfaces of a longitudinal primary core with a load carrying structural layer. The load carrying structural layer defines corresponding upper and lower outer surfaces. The method further entails overlying at least a portion of the upper outer surface of the structural layer with a secondary core. A top layer is applied over at least the secondary core and any exposed portions of the upper outer surface of the structural layer. A base layer is applied over the lower outer surface of the structural layer below the primary core.

The present invention thus provides a method to decouple mass distribution along the length of a ski from ski stiffness. The provision of a modular or secondary core positioned above the primary core, and outside of the beam formed from the structural reinforcing layers, enables the provision of increased total core thickness at desired locations along the length of the ski without a corresponding increase in ski stiffness. By constructing a ski with a secondary core disposed above the primary core and all of the major load carrying structural layers, core weight can be added to locations of the ski forward and rearward of the binding zone. In addition to determining the dynamic properties of the ski, the provision of a modular second core can reduce the effects of impact loads encountered by the ski tips.

In a further aspect of the present invention, a snowboard is provided that includes a longitudinal primary core defining upper and lower surfaces. A load carrying structural layer wraps at least the upper and lower surfaces of the primary core and defines corresponding upper and lower outer surfaces. A secondary core at least partially overlies the upper outer surface of the structural layer, above the primary core. A top layer covers at least the secondary core and any exposed portions of the upper outer surface of the structural layer. A base layer covers the lower outer surface of the structural layer below the primary core.

In one embodiment of a snowboard constructed in accordance with the present invention, the modular secondary core is formed in separate first and second portions disposed above first and second binding zones of the primary core. The secondary core thus serves as integral first and second lifter plates. A method of forming such a snowboard is also provided.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
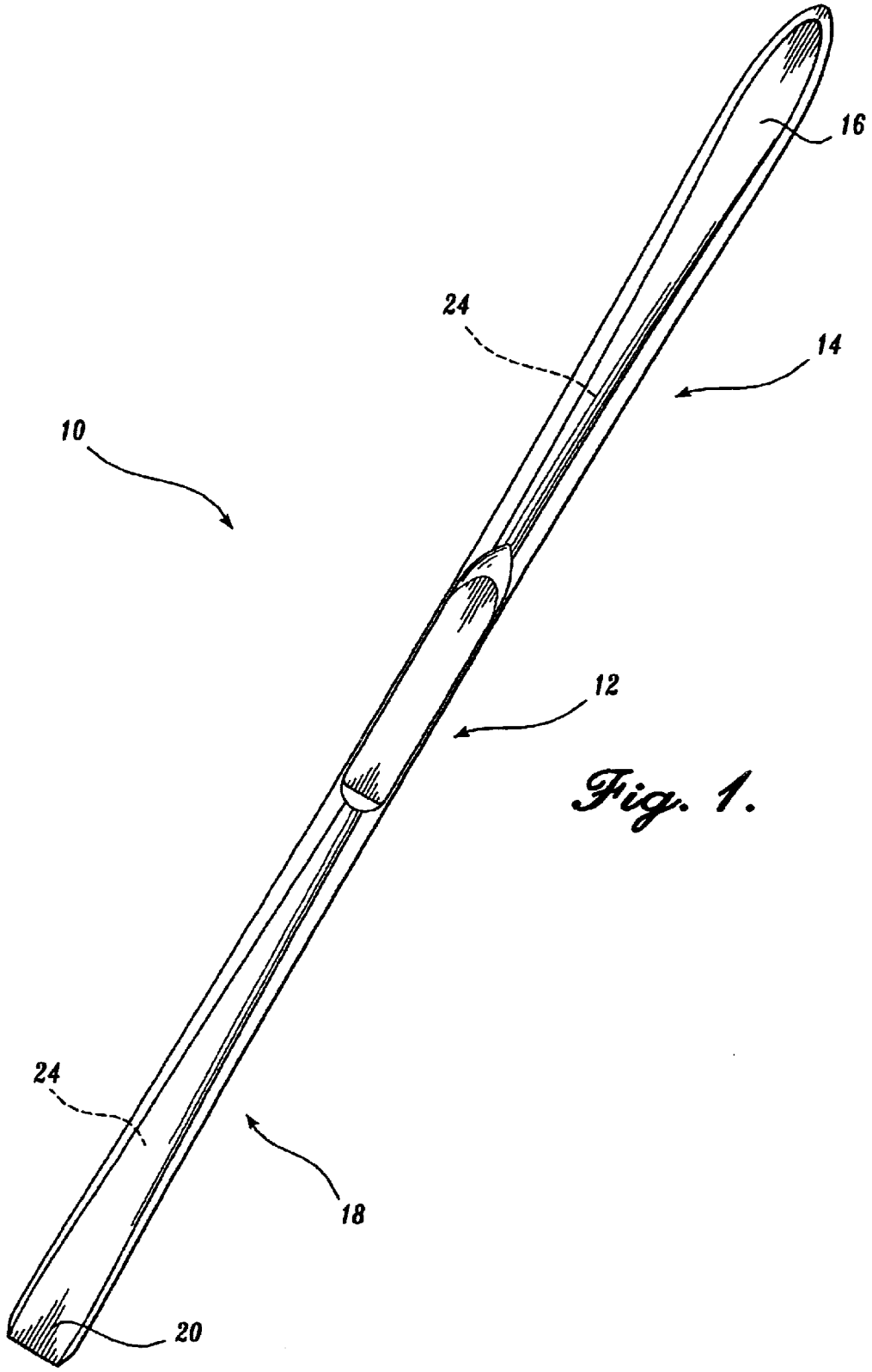
FIG. 1 provides a plan view of a ski constructed in accordance with a preferred embodiment of the present invention.

A preferred embodiment of a ski 10 constructed in accordance with the present invention is illustrated in FIG. 1. The elongate ski defines a flat central binding portion 12 to which the ski binding is mounted for fastening to a ski boot. The ski defines a fore body portion 14 terminating in a tip 16, and a rear body portion 18 terminating in a tail 20. As used herein, the term forwardly refers to the direction extending along longitudinal axis of the ski towards the tip 16, while the term rearwardly refers to the opposite direction.

While the preferred embodiment of the invention is illustrated in the form of an alpine ski 10, it should be readily appreciated that the foregoing may also be adapted for use in Nordic skis, snowboards, and other glide boards to effectuate a change in the mass distribution along the length of the board and thereby determine the dynamic profile of the glide board.

Figure 2:
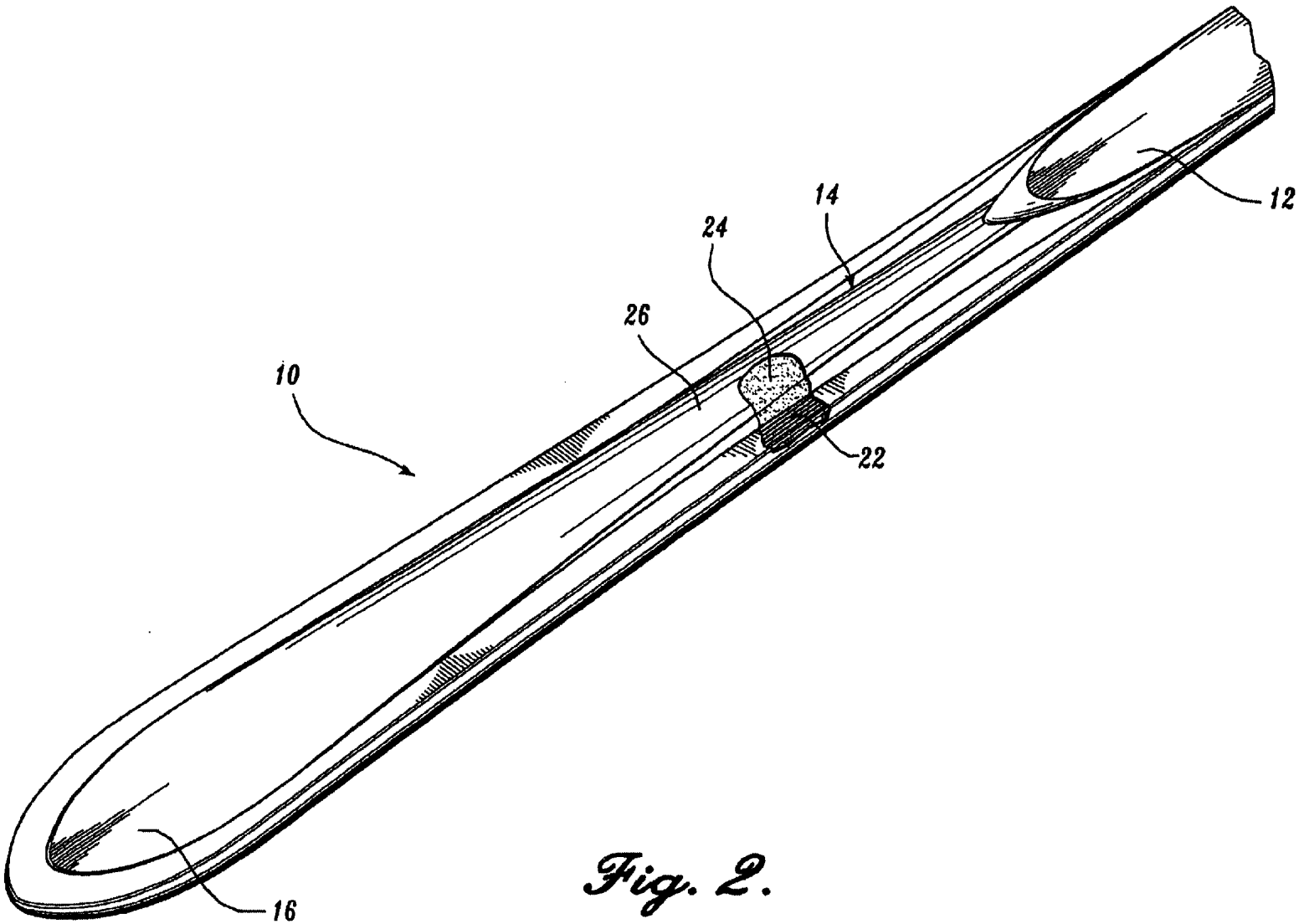
FIG. 2 provides a pictorial view of the fore body portion of the ski of FIG. 1, with a segment of the top layer removed to expose the secondary core.

Referring to FIG. 1 and FIG. 2, the ski 10 is formed from an internal body 22, as shall be described subsequently. In order to determine the mass distribution along the length of the ski, a secondary core 24 is applied along the length of, or portions of, the ski above the body 22. The secondary core 24 and body 22 are capped on the upper surface by a top layer 26. The secondary core 24 defines a ridge running along the length of the ski, below the top layer 26, that varies in width and height as desired for a predetermined mass distribution and dynamic profile. In the preferred embodiment illustrated in FIG. 2, the height or thickness of the secondary core 24 is greatest just forwardly of the binding zone 12. As the secondary core 24 extends forwardly along the length of the ski, it increases in width while initially remaining relatively constant in thickness. As the secondary core 24 extends further along the length of the fore body portion 14, it begins to taper in thickness while expanding in width, terminating just before the tip 16. This results in an increased mass of secondary core 24 in the fore body portion region just forwardly of the binding zone 12.

In the preferred embodiment of FIGS. 1 and 2, the secondary core 24 also extends in a thin layer below the binding portion 12. The secondary core 24 thus serves as an integral ski lifter. In the embodiment illustrated in FIG. 1, the secondary core 24 also extends rearwardly of the binding portion 12 in a fashion similar to the forward extension, so as to increase the mass of the secondary core 24 in the segment of the rear body portion 18 just rearwardly of the binding portion 12.

While the preferred embodiment of FIGS. 1 and 2 includes the secondary core 24 extending continuously along the length of the ski 10, with a minimum thickness below the binding portion 12 and increased mass forwardly and rearwardly of the binding portion 12, alternate configurations are within the scope of the present invention as may be desired to provide a ski with a given dynamic response profile. Thus, the secondary core 24 may be included only in the fore body portion 14, or only in the rear body portion 18. Further, rather than varying continuously as illustrated in FIG. 1, the thickness and width of the secondary core 24 may vary discontinuously as desired to concentrate mass over a given region of the ski. Build-up of mass through increased thickness of the secondary core 24 has a greater impact on ski performance the further the location of the build-up from the binding zone 12.

Figure 3:
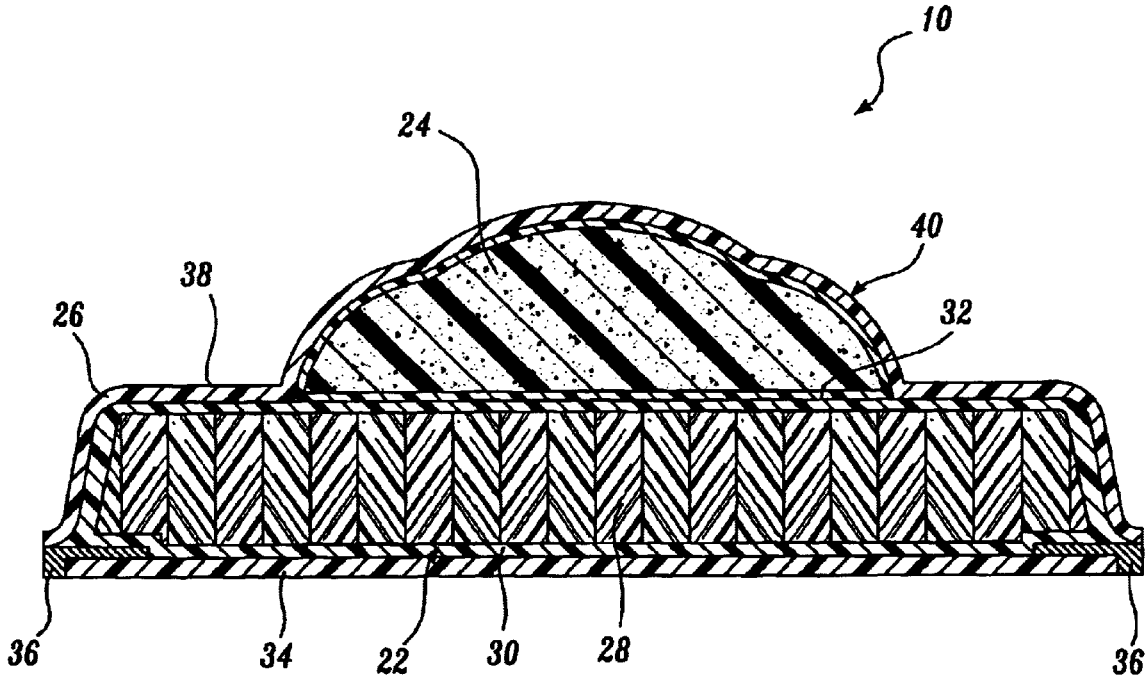
FIG. 3 provides a transverse cross section of the ski of FIG. 1 taken through the ski at a point forward of the binding zone.

Attention is now directed to FIG. 3 to describe the construction of the ski 10 in greater detail. The ski 10 is constructed from a conventional primary core 28. As illustrated, the primary core 28 is formed from laminated wood, however, other known core materials such as a rigid structural urethane foam or other polymer foams may be utilized. The primary core 28 is surrounded by a load bearing, structural reinforcing layer 30. In the preferred embodiment, the structural layer 30 wraps the upper and lower surfaces as well the sides of the primary core 28. However, in other types of conventional ski construction, also suitable for use in the present invention, the structural layer 30 may cover only the upper and lower surfaces of the primary core 28. Suitable materials for use in the structural layer 30 are known, such as fiber reinforced resins, e.g., polyester or epoxy resin reinforced with glass, polyaramide carbon fibers. Metals may also be incorporated into the core or structural reinforcing layer 30. The structural layer 30 may be single or multiple plys. The primary core 28 and surrounding structural layer 30 form the body 22 of the ski 10.

The secondary core 24 is disposed above the body 22, and thus above the primary core 28 and the upper outer surface of the structural layer 30. In the embodiment illustrated, the secondary core 24 is formed from a rigid structural foam such as a urethane foam. However, other core materials such as wood may alternately be utilized. Differing materials with differing densities, with or without volume change of secondary core along the length of the ski, may be utilized to form a secondary core with greater mass distribution. Thus first and second foam materials having first and second densities can be used to form the secondary core. The secondary core 24 is outside of and sits above the structural beam formed by the primary core 28 and the surrounding structural layer 30. Thus, the secondary core 24 does not significantly alter the stiffness of the ski. To further prevent an affect on the stiffness of the ski, the ski 10 preferably includes a thin elastomeric layer 32 between the lower surface of the secondary core 24 and the upper surface of the structural layer 30. This presents and enables limited shearing motion between the secondary core 24 and the body 22, which also serves to absorb shock.

The ski 10 further includes a top layer 26 or cap that overlies the upper surface of the secondary core 24, the exposed side portions of the upper surface of the structural layer 30 and, in the preferred embodiment illustrated, extends downwardly over the sides of the structural layer 30 as well. The preferred embodiment also preferably includes the elastomeric layer 32 extending between the upper surface of the secondary core 24 and the top layer 26. This facilitates shear between the secondary core 24 and the top layer 26. However, this is not as significant as is the presence of the elastomeric layer 32 between the secondary core 24 and the structural layer 30.

While the preferred embodiment of the ski 10 is illustrated as including a cap-type top layer 26 that extends downwardly to cover the sides of the body 22, other conventional constructions such as a top layer that covers only the upper surface of the ski and leaves the sides exposed to be covered with a separate sidewall layer are also within the scope of the present invention.

The ski is completed by a bottom layer 34 that underlies the lower outer surface of the structural layer 30, below the primary core 28. The edges of the bottom layer 34 are preferably reinforced with metal, such as steel edge strips 36. Materials for the top layer 26 and the bottom layer 34 are known in the art, including plastics such as urethane, acrylics, copolymers, and polyimide. Preferably, the top layer is formed from a pliant polymeric material, such as polyurethane, and the bottom layer (or base) of polyethylene.

Thus, referring to FIG. 3, it can be seen that ski 10 includes a secondary core 24 that is disposed above all major load carrying structures. The secondary core 24 thus affects overall ski stiffness minimally while adding mass to selected areas of the ski.

Referring to the profile shown in FIG. 3, it can be seen that the upper surface 38 defines a central ridge 40 under which the secondary core 24 is encased. The contour of the secondary core 24 illustrated is representative and may be varied as desired. The secondary core 24 is adhered firmly and nonremovably in place by the elastomeric layer 32 to the body 22 but may undergo limited shear movement. By covering the secondary core 24 with the top layer 40, the module represented by the secondary core 24 is permanently integrated with the module represented by the primary core 28.

The modular ski constructed in accordance with the present invention including a binary core, provides an integrated high performance suspension system for the ski. The secondary core 24 and elastomeric layer 32 insulates the skier from impact loads and vibrations in variable conditions, providing maximum edge-to-snow contact and a higher degree of control, power, ease and forgiveness. In a preferred embodiment, the elastomeric composite module defined by the secondary core 24 and elastomeric layer 32, extends from tip to tail. The secondary core 24 allows the body 22 of the ski to act independently under foot, while the secondary core 24 absorbs and insulates the skier from snow inconsistencies and impact loads. The preferable extension of the secondary core 24 into the fore body and rear body portions to the tip and tail, respectively, enables better edge control to be maintained during flexing of the ski. As the tip or tail of the ski flexes upwardly, for example, the secondary core 24 is able to move or extend longitudinally toward the tip or tail due to shearing in the elastomeric layer 32, thereby maintaining better edge-to-snow contact.

Figure 4:
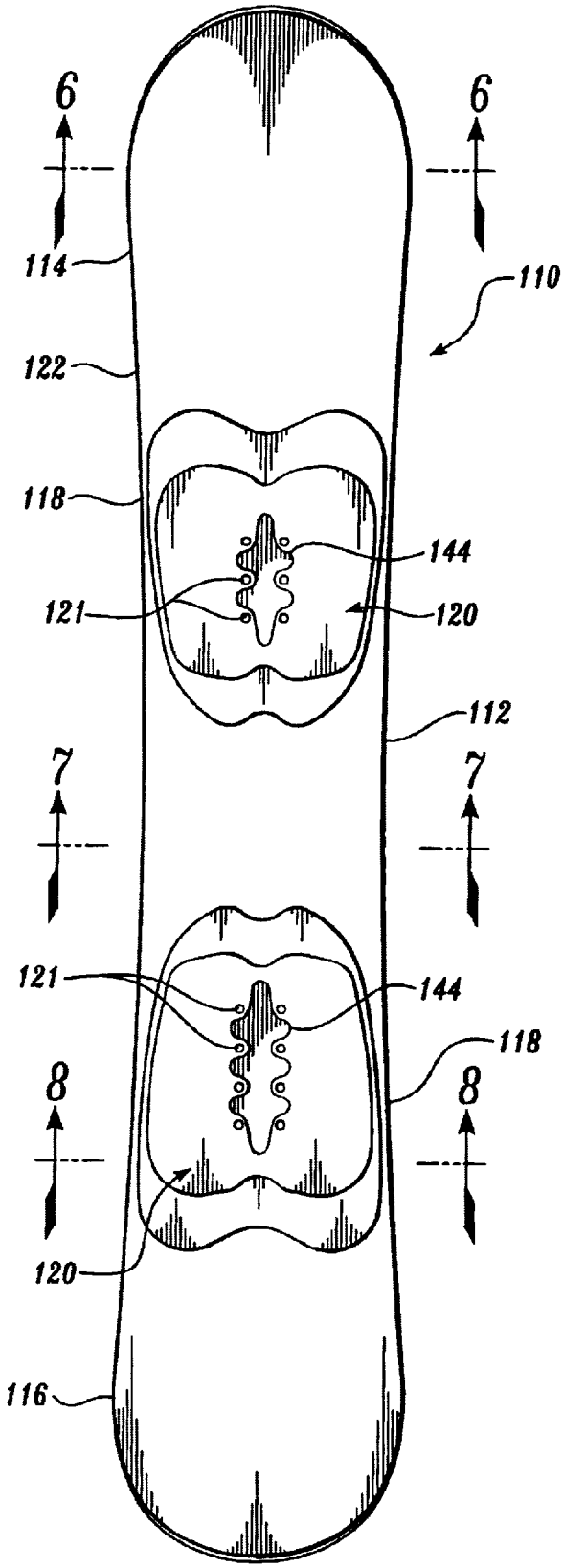
FIG. 4 provides a top plan view of a snowboard constructed in accordance with a second embodiment of the present invention.
Figure 5:
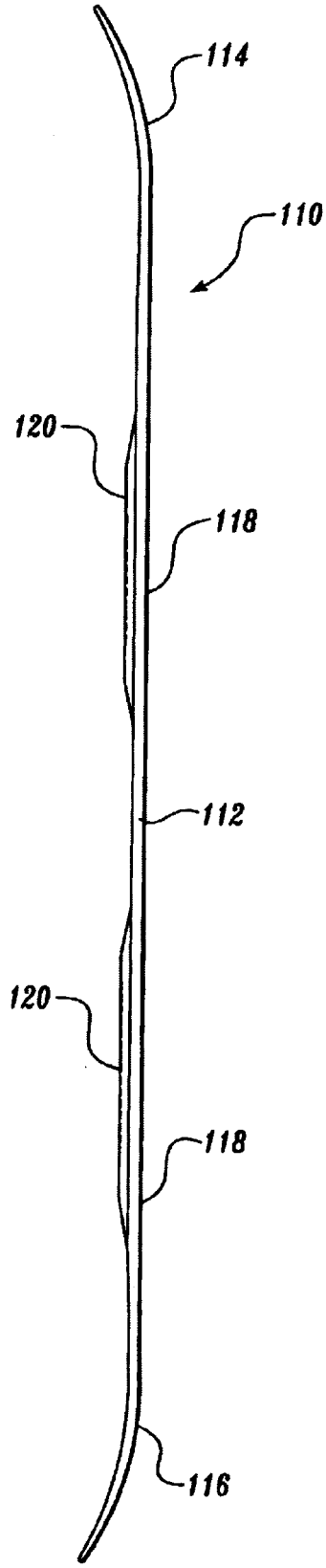
FIG. 5 provides a side elevation view of the snowboard of FIG. 4.

While the present invention has been described thus far in terms of a snow ski, it is readily adapted for use in a snowboard. A modular snowboard 110 constructed in accordance with the present invention is illustrated in FIGS. 4–8. The snowboard 110 includes a central section 112 bordered by a forward tip section 114 and an aft tail section 116, as can be seen in FIGS. 4 and 5. As used herein the term "forward" refers to the direction along the longitudinal axis of the board, toward the tip section 114, while the terms "aft" and "rearward" refer to the direction along the longitudinal axis of the board towards the tail section 116. The snowboard defines forward and rear binding regions 118, at opposite ends of the central section 112. Forward and rear integral lifter plates 120 are formed in accordance with the present invention on the upper side of the board, and each extends over a corresponding one of the binding regions 118, as will be described in greater detail herein below. A plurality of internally threaded metal inserts 121 are provided in each of the binding regions 118, for purposes of selectively securing conventional snowboard bindings (not shown). The positioning and construction of the inserts 121 is conventional, except for the length and vertical extension of the inserts, which shall be described subsequently.

Figure 7:
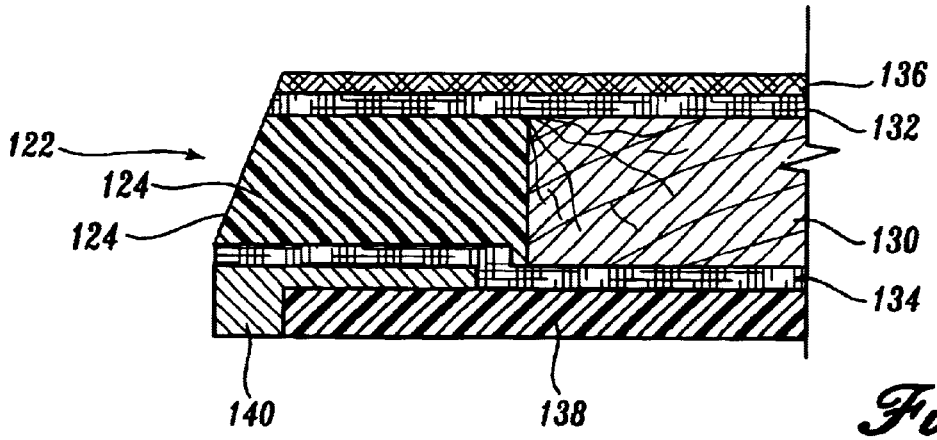
Figure 8:
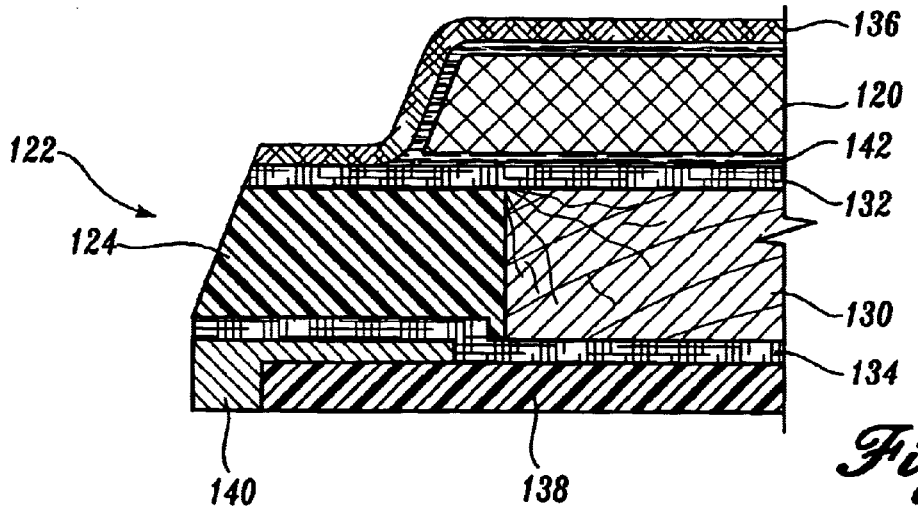

The snowboard 110 includes a perimeter edge 122. Longitudinal portions of the perimeter edge 122 are defined along either side of the central section 112 and binding regions 118 of the board, and are reinforced by first and second sidewall members 124 (FIGS. 7 and 8). Each sidewall member 124 extends from the forward contact point of the board, i.e., the point of greatest width if the forward end 114, to the aft contact point, e.g., the point of greatest width of the rearward end 116. Preferably, the sidewall members terminate shortly before the forward and aft contact points, such as 5–10 cm before the contact points. This enables a torsion box construction in the tip and tail, as described further below. The sidewall members 124 are preferably formed from a relatively rigid material that has a predetermined degree of resiliency. Suitable materials include polymers such as acrylonitrile-butadiene-styrene (ABS) resin, ABS/polyurethane blends, phenolic composites and the like. The sidewall members 124 do not extend around the forward edge of the tip section 114 or the rearward edge of the tail section 116. Rather, the forward and rearward edges and curved transitions of the tip section 114 and tail section 116 are absent, (i.e., devoid of), a sidewall member, instead having a tapered, capped construction. While the use of sidewall members is illustrated, the present invention is also suitably utilized with other forms of edge construction, such as a full sidewall board or a fully capped construction.

Figure 6:
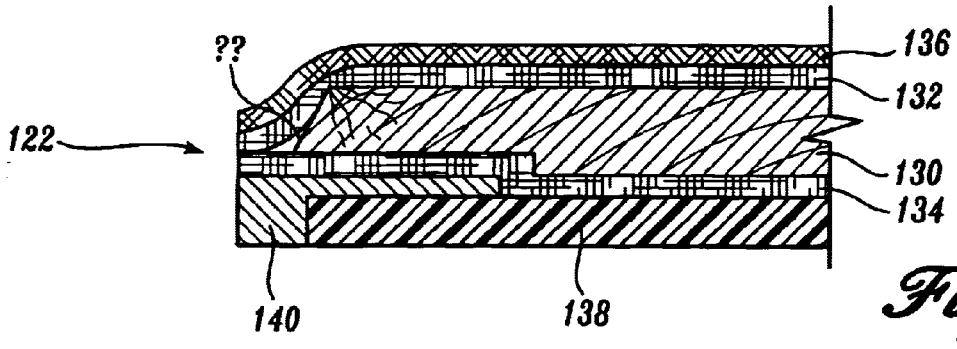
FIGS. 6, 7 and 8 provide transverse cross-sectional views of the edge region of the snowboard taken along lines 6—6, 7—7 and 8—8 of FIG. 4, respectively.

Attention is now directed to FIGS. 6–8 to describe the internal construction of the snowboard 110. The snowboard 110 includes a primary core 130, preferably constructed of wood, syntactic polyurethane foam or other known core materials. The primary core 130 extends the full width of the snowboard except for the width of the sidewall members 24, and is tapered along its edge in the tip and tail sections 14, 16. The core has a rectangular cross section in the central section 112.

The primary core 130 is reinforced by upper and lower reinforcement layers 132, 134, which layer the upper and lower surfaces of the primary core 130. The upper and lower reinforcement layers 132, 134 are suitably constructed from a composite material such as glass fiber reinforced polyester resin, graphite or Kevlar reinforced resin, or metal sheeting, in one or more layers as may be required for a desired degree of rigidity of the board. Additionally, other internal reinforcement structures, such as torsional reinforcement graphite or other material strips (not shown), may be incorporated into the board.

The upper reinforcement layer 132 is preferably covered with a top sheet 136. The top sheet 36 is formed from a conventional top sheet material, such as a urethane, acrylic, Nylon™ polyamid, a polybutylene terephthalate or blends thereof. The integral lifter plates 120, which cooperatively form a modular secondary core, are disposed on the upper surface of the upper reinforcement layer 132, below the top sheet 136, as can be seen in FIG. 8 and as shall be further described subsequently.

Attention is now directed to FIGS. 4, 5 and 8 to illustrate the construction of the lifter plates 120. The forward and rearward lifter plates 120 are identically contoured as a flat plate with a tapered edge, except for the number of binding inserts 121. Thus the lifter plate has a flat lower surface that spans substantially the entire with of the snowboard at the corresponding binding zone 118, approaching but spaced slightly from the edge 122 of the board. The upper surface of the lifter plate is also flat, and generally parallel to the lower surface. The upper surface is smaller than the lower surface, with a sidewall of the lifter plate tapering inwardly and upwardly from the lower surface to the upper surface. The degree of taper is greater at the forward and rearward edge of each lifter plate than on the sides of the lifter plate, with the forward and rearward edge thus being feathered to blend smoothly into the contour of the upper surface of the board. The length of each lifter plate, as measured in the longitudinal dimension of the snowboard, is greater on left and right sides of the lifter plate than along the center of the lifter plate, along the longitudinal axis of the snowboard. The perimeter of the lifter plate is thus "dimpled" in towards the center of the lifter plate in the middle of the forward and rearward edges of the lifter plate.

This "X" shape aspect to the overall ovoid profile of the lifter plate limits the reduction in torsional flexibility of the snowboard through the center section 112 of the board, and torsional stiffness in the binding regions 118. The forward and rearward binding plates 120 are preferably separated from each other by the center section 112 of the snowboard, and as such also do not interfere with longitudinal flexibility and torsional flexibility of the central section 112. In an alternate embodiment (not shown), the first and second lifter plates may be connected as a unitary secondary core, with the thickness of the secondary core in the central section 112 of the board being reduced substantially between the binding regions.

Like the ski embodiment of FIG. 1, the secondary core of the snowboard of FIG. 4, formed from the first and second lifter plates, is isolated from the load bearing structure of the primary core 130 wrapped by the structural layers 132 and 134. As in the aforementioned ski, the lifter plates 120 are joined to the underlying upper structural layer 132 by an elastomeric shear layer 142 (FIG. 8). The elastomeric shear layer 142 permits limited shearing motion between the lifter plates 120 and the reinforced core, for increased board flexibility. Preferably, the elastomeric shear layer also wraps the sides and upper surface of the lifter plates 120.

Each lifter plate is formed from a lightweight core material that has inherent vibration dampening properties. A suitable material is a substantially rigid syntactic polyurethane foam. Other materials having light weight, stiffness in compression, and a predetermined degree of vibration dampening, such as wood, may be utilized. The elastomeric shear layer 142 also acts as a dampening component. Together, the lifter plates 120 and shear layer 142 act to damp out vibrations before they reach a rider's feet, for better control.

To account for the increased thickness of the snowboard 110 in the binding regions 118, the binding inserts 121 have a greater length than in conventional boards. The inserts 118 thus extend from the lower surface of the primary core 130, through the primary core 130 and the corresponding binding plate 120, to the upper surface of the binding plate 120, opening through the top sheet 136.

As an optional aspect of the present invention, a binding locator recess 144 is formed in the upper surface of each lifter plate 120. Each recess 144 is elongate and runs longitudinally between opposing rows of binding inserts 121, and expanding in width to extend transversely between each adjacent pair of inserts 121 in each row. Each recess 144 thus defines a serpentine path along each longitudinal edge thereof. The top sheet 136 conforms to the shallow recesses 136, leaving a visible depression that can also be sensed by feel to highlight insert location.

The lifter plates 120 serve to elevate the boarder's feet above the load bearing structural layer of the board, and above the upper surface of the surrounding remainder of the board. This elevation results in increased leverage for the boarder, who has a greater ability to transmit pressure to the board edges for improved control and quicker power transfer. The boarder can also tilt the board further backward on the heel edge, or frontward on the toe edge, before the heel or toe, respectively, of the boarder's boots begin to drag. This reduces drag while boarding, and also enables a boarder with long feet to use a narrower board for quicker edge to edge transfer.

Figure 9:
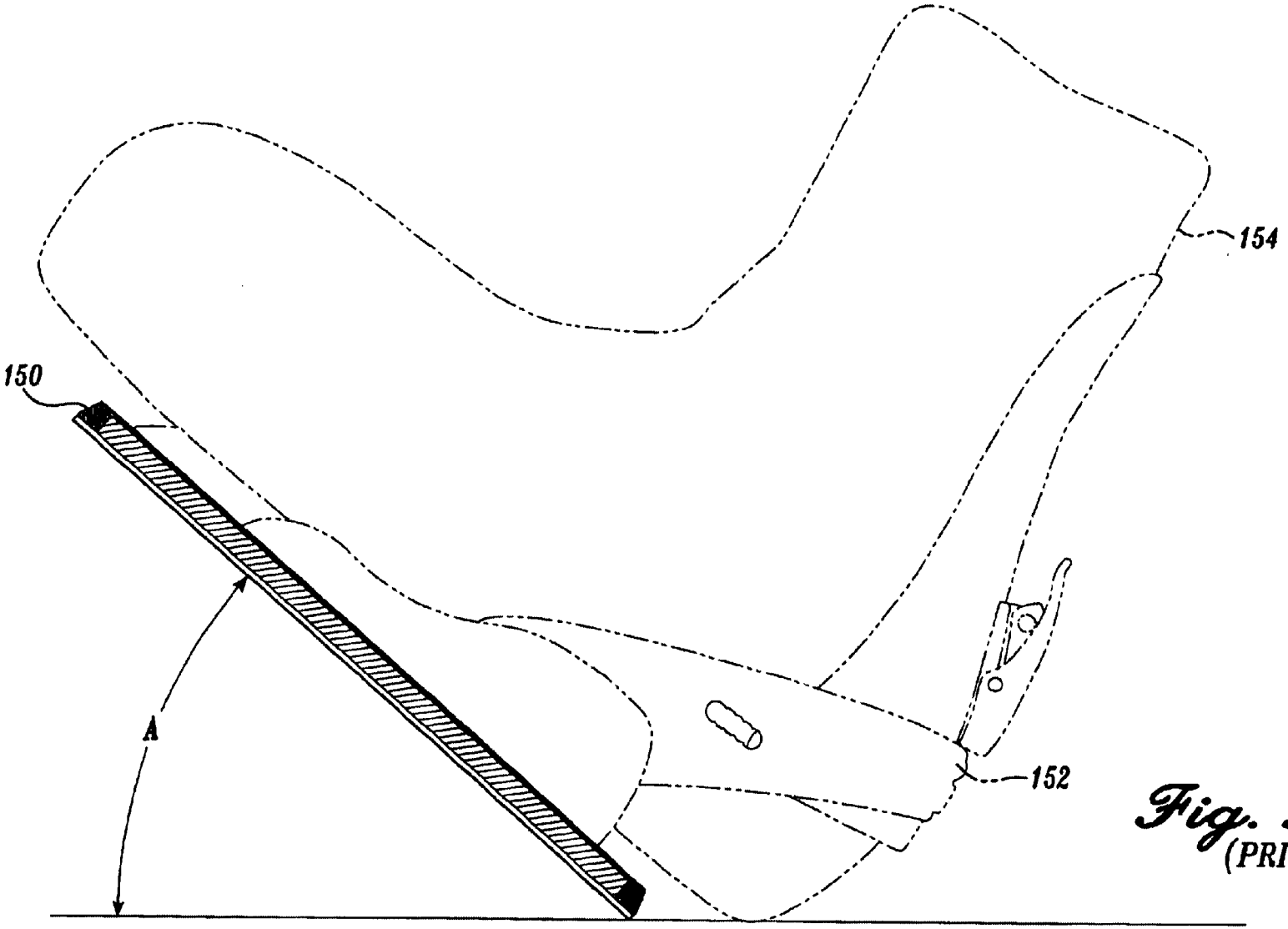
Fig. 9. (PRIOR ART)
FIG. 9 provides an illustration of the rearward lean possible when using a conventional prior art snowboard, with the snowboard show in transverse cross section and a boot and binding shown in phantom.
Figure 10:
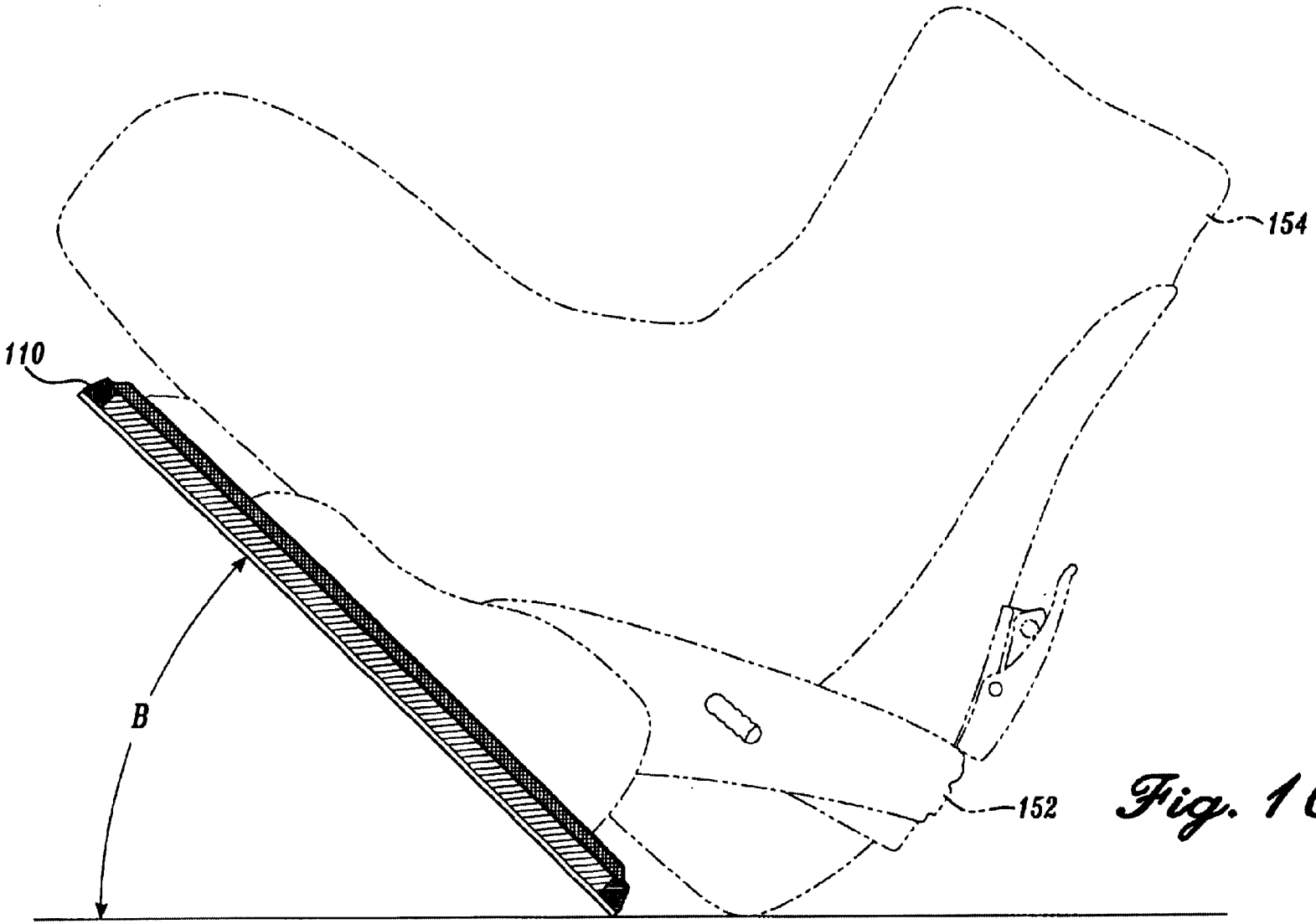
FIG. 10 provides an illustration of the rearward lean possible when using the snowboard of FIG. 4, with the snowboard show in transverse cross section and a boot and binding shown in phantom.

This aspect of the invention is better understood with reference to FIGS. 9 and 10. FIG. 9 illustrates a conventional snowboard 150, to which a boot 154 is secured by a binding 152. The snowboard 150 can be tipped backwards relative to the ground at an angle A before the boot heel impacts the ground. In contrast, FIG. 10 illustrates the snowboard 110 of the present invention, which can tip backwards at a greater angle B. In the illustrated embodiment, a lifter plate thickness of about 4 mm results in an increase in maximum angle from 40 degrees to 45 degrees. Other lifter plate thicknesses can be selected to achieve a desired maximum angular tip before inducing drag through heel (or toe) contact.

The snowboard further includes a base 138 formed of a conventional durable low-friction material, such as ultra-high molecular weight polyethylene. Thus in the preferred embodiment, the snowboard is constructed from top to bottom, from a top sheet 136, which overlies and is joined to an upper reinforcement layer 132, which overlies and is joined to the primary core 130, which overlies and is joined to the bottom reinforcement layer 134, which overlies and is joined to the base 138. In the binding regions 118, the integral lifter plates 120 are disposed between the top sheet 136 and the upper reinforcement layer 132. The edge of the base 138 is reinforced, preferably along the full perimeter of the board, by a metal edge member 140, suitably constructed of steel, as is well known in the art. The metal edge member 140 is preferably mounted by a flange that is received between the base 138 and lower reinforcement 134, to provide a sharp edge for cutting into the snow.

The snowboard 110 can be suitably manufactured by several methods. In a first preferred method, a block of material, such as wood or a wood laminate, used to form the primary core 130 is formed and shaped. An elongate recess is then cut into each side of the core material to form a side cut recess that will receive a sidewall member 124. This block of core material is then sliced along horizontal planes to form individual core members, each of which includes two longitudinal side cuts to receive sidewall members. Alternatively individual primary core members 130 could first be cut, with side cut recesses then being formed in each such primary core 130. When a foam core is used, the side cut recesses may be formed in the core by molding.

Two rectangular elongate strips forming the sidewall members 124 are then adhered using an adhesive to the longitudinal edges of the primary core 130, within the side cut recesses provided therefor. The thusly assembled primary core including sidewall members 124 can then be further shaped to define the desired profile and tip and tail configurations. This procedure assumes the use of partial sidewall members, but as is apparent would be modified in accordance with known technique to implement a full sidewall or fully capped construction.

The lifter plates 120 are separately formed, suitably from injecting a self skinning polyurethane foam into a mold cavity.

The snowboard is then completed using conventional molding techniques, by layering within a mold the base, then the bottom reinforcement layer 134, then the primary core 130 including the sidewall members 124 assembled thereto, then the top reinforcement layer 132, then the lifter plates 120 that have been coated on upper and lower sides with an elastomeric film, and then the top sheet 136. The assembled layers are then molded between upper and lower mold halves, applying heat and pressure to shape and adhere the layers together in accordance with conventional molding techniques. While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A snowboard including a central section and first and second binding regions, comprising:

a longitudinal primary core defining upper and lower surfaces;

a load carrying structural layer wrapping at least the upper and lower surfaces of the primary core defining a structural beam having a stiffness and defining corresponding upper and lower outer surfaces;

first and second lifter plates overlying the upper outer surface of the structural layer in the first and second binding regions, above the primary core without substantially changing the stiffness of the structural beam;

a top layer covering the lifter plates and any exposed portions of the upper outer surface of the structural layer; and a base layer covering the lower outer surface of the structural layer, below the primary core.

2. The snowboard of claim 1, wherein the first and second lifter plates are separate from each other.

3. The snowboard of claim 2, wherein at least one of the first and second lifter plates has a perimeter that defines an ovoid shape.

4. The snowboard of claim 1, wherein the primary core defines a longitudinal axis, and at least one of the lifter plates defines a central length determined along the longitudinal axis and left and right edge lengths, the central length being less than the left and right edge lengths.

5. The snowboard of claim 4, wherein at least one of the first and second lifter plates defines a thickness and a perimeter edge, the thickness of the lifter plate tapering at the perimeter edge.

6. The snowboard of claim 1, further comprising a plurality of binding inserts disposed within the first and second binding regions of the snowboard, each extending from the lower surface of the primary core, through the primary core and a corresponding one of the lifter plates, to an upper surface of the lifter plates.

7. The snowboard of claim 6, further comprising a locator recess defined in the upper surface of each lifter plate adjacent upper ends of the binding inserts.

8. The snowboard of claim 1, wherein the lifter plates are constructed from a material selected from the group consisting of wood and polymeric foam.

9. The snowboard of claim 1, wherein the top layer covers an upper surface of the lifter plates and extends downwardly to cover portions of sides of the primary core.

10. The snowboard of claim 1, further comprising an elastomeric layer disposed between the lifter plates and the upper outer surface of the structural layer.

11. The snowboard of claim 10, wherein the elastomeric layer surrounds the lifter plates between the upper surface of the structural layer and the top layer.

12. The snowboard of claim 1, wherein the lifter plates are integrated into the snowboard and are covered only by the top layer.

13. The snowboard of claim 1, wherein the load carrying structural layer defines an upper nominal plane of the snowboard, and the lifter plates are disposed above the upper nominal plane.

14. The snowboard of claim 1, wherein the first and second lifter plates have a predetermined degree of vibrational dampening.

15. A snowboard including a central section and first and second binding regions, comprising:

a longitudinal primary core defining upper and lower surfaces;

a load carrying structural layer wrapping at least the upper and lower surfaces of the primary core defining a structural beam having a torsional stiffness and defining corresponding upper and lower outer surfaces;

a secondary core at least partially overlying the upper outer surface of the structural layer above the primary core within at least one of the first and second binding regions without substantially changing the torsional stiffness of the structural beam;

a top layer covering the secondary core and any exposed portions of the upper outer surface of the structural layer; and a base layer covering the lower outer surface of the structural layer, below the primary core.

16. A snowboard including a central section and first and second binding regions, comprising:

a body having a body stiffness and formed from a primary core reinforced by at least one load carrying structural layer;

first and second lifter plates, each having a stiffness, overlying portions of the body within the first and second binding regions outside of the at least one load carrying structural layer, wherein the stiffness of the first and second lifter plates is substantially less than the body stiffness;

a top layer covering at least portions of the first and second lifter plates and integrating the first and second lifter plates onto the body; and a base layer covering the lower outer surface of the body.

17. The snowboard of claim 16, further comprising an elastomeric layer disposed between the first and second lifter plates and an upper surface of the body.

18. A method of fabricating a snowboard defining a central section and first and second binding regions, comprising:

wrapping at least upper and lower surfaces of a primary core with a load carrying structural layer; to define a structural beam having a stiffness, the load carrying structural layer defining corresponding upper and lower outer surfaces;

placing first and second lifter plates over the first and second binding regions of the upper outer surface of the structural layer without substantially changing the stiffness of the structural beam;

applying a top layer over the first and second lifter plates and at least segments of any exposed portions of the upper outer surface of the structural layer; and applying a base layer over the lower outer surface of the structural layer below the primary core.

19. The method of claim 18, further comprising applying an elastomeric layer over the upper outer surface of the load carrying structural layer, between the load carrying structural layer and the first and second lifter plates.

* * * * *